United States Patent [19]

Dupuis, Jr.

[11] Patent Number: 4,641,467

[45] Date of Patent: Feb. 10, 1987

[54] COLUMN CONSTRUCTION

[76] Inventor: A. J. Dupuis, Jr., 127 W. White St., Opelousas, La. 70570-3596

[21] Appl. No.: 821,011

[22] Filed: Jan. 21, 1986

[51] Int. Cl.[4] ..... E04H 12/00

[52] U.S. Cl. ..... 52/297; 52/298; 52/301; 52/744

[58] Field of Search ..... 52/301, 300, 296, 297, 52/298, 263, 744

[56] References Cited

U.S. PATENT DOCUMENTS

| | | | |
|---|---|---|---|
| 813,450 | 2/1906 | Robinson | 52/301 |
| 882,398 | 3/1908 | Lupo | 52/301 |
| 1,000,822 | 8/1911 | Kyle | 52/298 |
| 1,549,428 | 8/1925 | Barrick | 52/301 |
| 2,240,016 | 4/1941 | Pinney | 52/296 |
| 3,193,255 | 7/1965 | Burdett | 52/301 |
| 3,902,294 | 9/1975 | Brown | 52/301 |
| 4,330,970 | 5/1982 | Bonink | 52/263 |

*Primary Examiner*—Henry E. Raduazo

*Attorney, Agent, or Firm*—Flehr, Hohbach, Test, Albritton & Herbert

[57] ABSTRACT

A reinforced concrete column having novel capital and base constructions so constructed that interfitting circular and annular keys are provided which ensure vertical alignment and provide for carrying the load applied to the column independently of grouting.

6 Claims, 4 Drawing Figures

COLUMN CONSTRUCTION

This invention relates generally to column constructions suitable for use in building or colonnade structures, and to methods for their manufacture.

BACKGROUND OF THE INVENTION

Column assemblies having shafts made of reinforced concrete are widely used in building constructions and colonnades. The shaft and also the capital and base forming the complete column may conform with the architecture of the building. The capital and base may be separately formed and assembled with the column shaft during the work of erecting a building. The complete assembly must be adequate to take the vertical load forces that may be applied. Also it is desirable to provide interfitting parts which facilitate vertical alignment of the shaft with the capital and base. Grouting may be used in assembling certain parts but may introduce difficulties. For example, it is known that grouting may be weaker in compression than present day reinforced concrete of high density such as is used in making column shafts, or may be more susceptible to deterioration by weathering. Thus grouting may cause difficulty if relied upn to take all or a part of the load. Therefore members of the assembly separated by grouting may be subject to deterioration or possible failure.

OBJECTS OF THE INVENTION AND SUMMARY

In general it is an object of the present invention to provide a reinforced concrete column assembly which may be readily erected and which facilitates grouting operations.

Another object of the invention is to provide a column assembly in which grouting does not carry any of the load applied to the column.

A further object is to provide capital and base or both capital and base constructions which have key members that ensure alignment with the axis of the column shaft and also carry vertical load on the column.

The present invention consists of a column assembly that is suitable for buildings and colonnades and which comprises a main column shaft that is annular in cross-section and formed on dense reinforced concrete. The base of the assembly consists of a base member having a flat upper face on which a circular key is mounted. An annular key is formed on the lower end of the shaft. The dimensions of the circular and the annular keys are such that when the shaft is assembled upon the base, the annular key is caused to embrace the circular key, and an annular space is provided for receiving grouting. A comparable assembly is provided for the capital.

Additional features of the invention will appear from the following description in which the preferred embodiment of the invention has been disclosed.

REFERRING TO THE DRAWING

Figure 1:
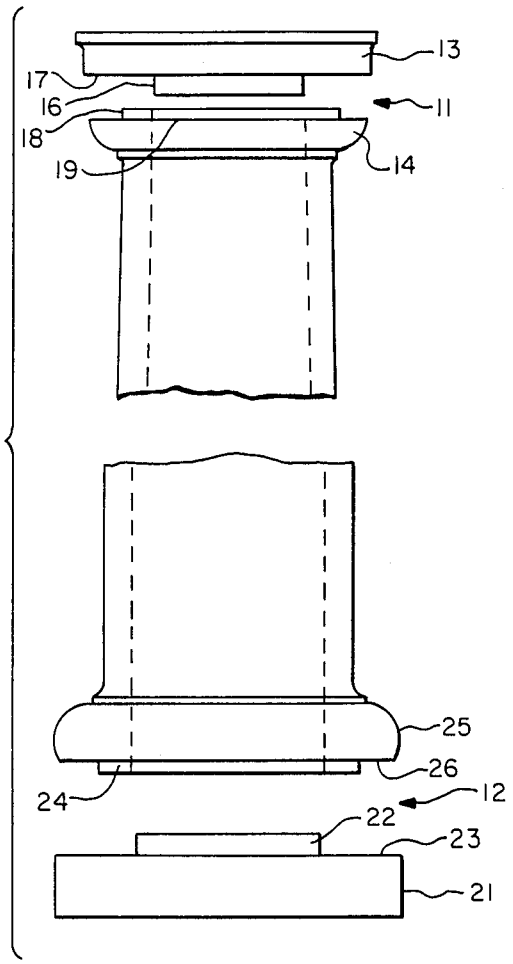
FIG. 1 is a side elevation exploded view showing the shaft and parts of the capital and base assemblies.
Figure 3:
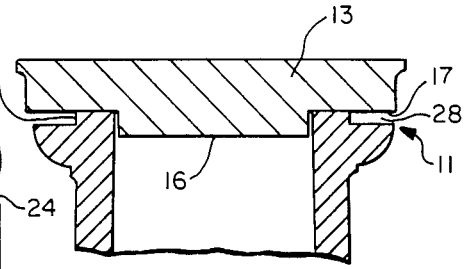
FIG. 3 is a detail in section showing the capital assembled on the upper end of the shaft.

The drawing illustrates a typical architechural type of column incorporating the present invention. As shown in FIG. 3, the parts of the column are completely assembled except for application of grouting. In general these parts consist of the main shaft 10, the capital 11, and the base 12. FIG. 1 illustrates the separate portions of the capital and base. The capital consists of the cap member 13, which may be square or other configuration depending upon the character of the building construction. A molding 14 is also shown disposed about the corresponding end of the shaft and preferably is fored integral with the shaft. A circular key 16 is fixed to the lower flat side 17 of the cap 13. Preferably the key 16 and the cap 13 are formed integral, and have suitable reinforcement. Another annular key 18 is formed on the adjacent end of the shaft. The circular key 16 is dimensioned whereby it interfits the annular key 18 in the final assembly. The flat upper face 19 of the molding 14 surrounds the key 18, and coincides with a plane normal to the axis of the shaft. The base assembly 12 likewise consists of a base member 21 which may be of square configuration, and which normally rests upon a supporting structure, such as a portion of a building. A circular key 22 is fixed to the upper flat face 23 of the base member, and the two parts may be made integral and with suitable reinforcement. The lower end of the shaft likewise has an integral molding 25. An annular key 24 is fixed to the lower end of the shaft, and is dimensioned whereby in the final assembly it surrounds the circular key 22. The molding has a lower annular face 26 which is coincident with a plane normal to the axis of the shaft.

Figure 4:
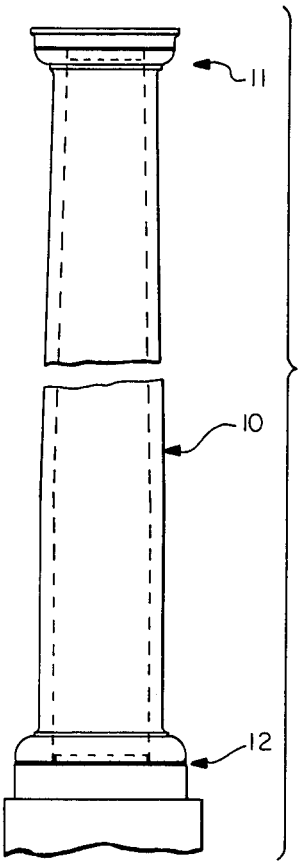
FIG. 4 is a side elevation view showing the completely assembled column.
Figure 2:
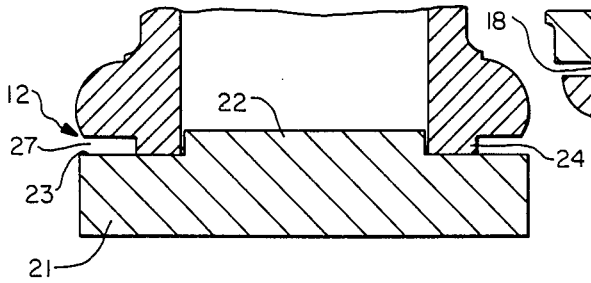
FIG. 2 is a cross-sectional detail showing interfitting portions of the base assembly.

At the time the shaft is assembled it is assumed that the base member 21 is fixed to a suitable supporting surface of the building, and that its upper face 23 is horizontal. The shaft is brought into axial vertical alignment with the key 22, and then lowered until the key 24 surrounds the key 22, and comes to rest upon the upper surface 23 of the base member (FIG. 2). The dimensions of the key 24 are such that the two faces 23 and 26 are parallel and spaced apart a sufficient distance to provide an annular space or gap 27 to receive grouting. The cap 13 is then assembled upon the upper end of the shaft, with the annular key 18 surrounding the circular key 16 (FIG. 3). Again the annular key 18 is so dimensioned that when the cap is seated upon the shaft, the two faces 17 and 19 are parallel and spaced apart a sufficient distance to provide an annular space or gap 28 to receive grouting. Finally, grouting is applied to fill the space between faces 23 and 26 of the base and faces 17 and 19 of the capital, to complete the column assembly (FIG. 4).

The present invention has a number of features which facilitate erection and completion of a column. The use of the interfitting keys 22 and 24 provides effective means for ensuring proper vertical alignment of the shaft with the capital and base assemblies. Also it provides a type of interlock capable of resisting loads applied laterally of the column. Loads applied to the capital are effectively carried by the capital and base assemblies, and is not carried by the grouting which is applied after the assembly operations. Thus the grouting is independent of vertical loading, and if there should be some disintegration of the grouting through weathering, it does not affect the load carrying ability of the column.

Although the column described above is of a particular architectural type, it is evident that other architectural types can be employed with proper modification of the parts of the capital and base assemblies. Known techniques can be used to manufacture the reinforced shaft. One technique uses a cylindrical mandrel assembly mounted for rotation about a horizontal axis. The wall of the column is built up by applying mortor and reinforcement until the desired configuration and wall thickness is attined.

What is claimed is:

1. A column assembly for buildings comprising a main column shaft made of concrete and that is annular in cross-section, a base and a capital at the lower and upper ends of the shaft respectively, the base comprising a base member having a flat upper face, a circular key mounted on the upper face of the base, an annular key formed integral with the lower end of the shaft and concentric with the shaft axis, the lower end of the shaft having an integral annular molding which has an outer diameter that is substantially greater than the exterior diameter of the lower portion of the shaft and also having a lower annular face coincident with a plane normal to the axis of the shaft and surrounding the annular key, the vertical dimension of the annular key being such that when the shaft is assembled on the base member with the annular key embracing the circular key, the annular key carries the load applied to the shaft and provides an annular gap between the upper face of the base member and the said lower annular face of the annular molding, said annular gap being filled with non-load bearing grouting.

2. A column assembly as in claim 1 in which the annular molding is formed integral with the shaft.

3. A column assembly as in claim 1 in which the capital comprises a cap member having a flat lower face, a circular key fixed to the cap member and extending downwardly from said face, an annular key fixed to and formed integral with the upper end of the shaft, the upper end of the shaft having an annular moulding that has an upper annular face coincident with a plane normal to the axis of the shaft and surrounding the annular key, the molding being integral with the shaft and having an outer diameter that is substantially greater than the external diameter of the upper portion of the shaft, the dimensions of the annular key fixed to the upper end of the shaft being such that when the capital is assembled on the upper end of the shaft with the annular key embracing the circular key, the annular key carries the load applied by the cap member to the upper end of the shaft and provides a gap between the lower face of the cap member and the upper annular face of the annular moulding on the upper end of the shaft, said last mentioned gap being filled with non-load bearing grouting.

4. In a column assembly for a building, a main column shaft made of concrete, the column shaft being annular in cross section in a plane normal to the axis of the shaft, a base disposed at the lower end of the shaft, a cap disposed at the upper end of the shaft, the base comprising a base member having a flat upper face, a circular key mounted on the upper face of the base, an annular key carried by and integral with the lower end of the shaft and concentric with the shaft, the lower end of the shaft having an integral annular moulding that has a lower annular face coincident with a plane normal to the axis of the shaft and surrounding the annular key, the dimensions of the annular key being such that when the shaft is assembled on the base member with the annular key embracing the circular key, the annular key carries a load applied to the shaft and provides an annular gap between the upper face of the base member and the lower annular face of the annular moulding, said gap being filled with non-load carrying grouting, the capital comprising a cap member having a flat lower face, a circular key carried by the cap member and extending downwardly from said face, an annular key carried by the upper end of the shaft, the upper end of the shaft having an annular moulding that has an upper annular face coincident with a plane normal to the axis of the shaft and surrounding the annular key, the dimensions of the annular key being such that when the cap is assembled on the upper end of the shaft with the annular key embracing the circular key, the annular key carries the load applied by the cap member to the upper end of the shaft and provides an annular gap between the lower face of the cap member and the upper annular face of the annular moulding on the upper end of the shaft, said last mentioned annular gap being filled with non-load bearing grouting.

5. An assembly as in claim 4 wherein the annular keys and the mouldings provided on the upper and lower ends of the shaft are formed integral with the shaft.

6. A method of assembling a concrete column shaft upon a supporting means using a base member having a horizontal upper face and a circular key fixed to the base member and extending upwardly from said face, and a column shaft having one end provided with an annular key dimensioned to embrace the circular key and also having an annular face surrounding the annular key and coincident with a plane perpendicular with the axis of the shaft, the method comprising the steps of erecting the column and seating its said one end upon the base member with the annular key embracing the circular key, the dimensions of the annular key being such that when so erected an annular gap is provided between the upper face of the base member and the lower annular face of the shaft surrounding the circular key, and then filling the gap between said faces with grouting whereby the grouting is independent of vertical loading of the column.

* * * * *